US007325344B2

(12) United States Patent
Eaton

(10) Patent No.: US 7,325,344 B2
(45) Date of Patent: Feb. 5, 2008

(54) GROUND-MOUNTED IMPACT INSERTION AND EXTRACTION APPARATUS

(76) Inventor: Roger G. Eaton, 11909 Mohawk Rd., Leawood, KS (US) 66209

( * ) Notice: Subject to any disclaimer, the term of this patent is extended or adjusted under 35 U.S.C. 154(b) by 388 days.

(21) Appl. No.: 10/854,442

(22) Filed: May 26, 2004

(65) Prior Publication Data

US 2004/0237453 A1 Dec. 2, 2004

Related U.S. Application Data

(60) Provisional application No. 60/473,555, filed on May 27, 2003.

(51) Int. Cl.
*G09F 15/00* (2006.01)
*G09F 15/02* (2006.01)

(52) U.S. Cl. ..... 40/607.05; 40/607.06; 40/607.09

(58) Field of Classification Search ..... 40/607.01, 40/607.04, 607.05, 607.06, 607.03, 607; 52/38, 40, 165, 298, 155, 296; 173/126, 173/128, 130, 90; 73/82; 81/463
See application file for complete search history.

(56) References Cited

U.S. PATENT DOCUMENTS 1,889,910 A * 12/1932 Weamer ..... 40/624
1,943,018 A * 1/1934 Hench ..... 52/165
2,025,004 A * 12/1935 Shearer ..... 40/607.04
2,098,146 A * 11/1937 Hunt ..... 173/126
2,742,266 A * 4/1956 Voelkerding ..... 175/19
2,759,486 A * 8/1956 Pesaturo ..... 135/16
2,934,984 A * 5/1960 Woodman ..... 72/457
3,143,617 A 8/1964 Paulson
4,279,104 A 7/1981 Classen
4,524,533 A * 6/1985 Still, Jr. ..... 40/607.06
5,174,388 A * 12/1992 Williams et al. ..... 173/1
5,370,192 A * 12/1994 Evinger ..... 173/90
5,722,205 A * 3/1998 Gannaway ..... 52/155
6,138,501 A * 10/2000 Rastegar ..... 73/82
6,973,822 B1 * 12/2005 Sawyers ..... 73/82
2002/0070321 A1 6/2002 Womack

OTHER PUBLICATIONS

Durham Geo ; http://web.archive.org/web/20031020170527/http://durhamgeo.com/testing/soils/field-testing-dynconepen.html ; Oct. 20, 2003.*

* cited by examiner

*Primary Examiner*—Lesley D. Morris
*Assistant Examiner*—Christopher E Veraa
(74) *Attorney, Agent, or Firm*—Mark E. Brown

(57) ABSTRACT

An apparatus for impact insertion in and extraction from the ground includes a core with an upper section adapted for mounting a device, such as a sign, and a lower section with a pointed lower end. A reduced-diameter guide shaft extends between the upper and lower sections. An impact sleeve assembly includes a hollow tube and impact collar fixedly mounted therein. The core is reciprocally received in the sleeve with the impact collar adapted for sliding on the guide shaft between the core upper and lower sections for impacting same on extraction and insertion strokes respectively.

12 Claims, 10 Drawing Sheets

(EXTENDED)

(EXTENDED)

(RETRACTED)

GROUND-MOUNTED IMPACT INSERTION AND EXTRACTION APPARATUS

CROSS-REFERENCE TO RELATED APPLICATION

This application claims the benefit of U.S. provisional application No. 60/473,555, filed May 27, 2003, which is incorporated herein by reference.

BACKGROUND OF THE INVENTION

1. Field of the Invention

The present invention relates generally to impact insertion and extraction devices, and in particular to ground-mounted standards for mounting signs, temporary and relocatable lighting, stakes for attaching lines and related applications.

2. Discussion of the Related Art

Numerous devices are ground-mounted on poles, stakes and the like. For example, yard signs are commonly installed by placing one or more upright standards in the earth. Signage is commonly fastened to the upper ends of such standards. The standards can comprise poles, rods, tubes, heavy-gauge wire and other elongated members, which are adapted for pushing or pounding into the ground in generally upright orientations. Extraction can generally be accomplished by pulling upwards with sufficient force to disengage the standards. Such prior art constructions are in widespread usage with many types of devices mounted thereon.

Ground-based display devices may require relocation and replacement. For example, real estate agents commonly install "For Sale" and "For Rent" signs in the yards of their property listings and elsewhere. Such installations are typically removed when the properties sell or lease. Political signs comprise another class of "temporary" signage, because they are typically removed after elections. Various other signage types are temporarily installed, and then removed or replaced after serving their specific purposes.

Relatively hard ground conditions can impede installing and removing ground-mounted devices. Such conditions can contribute to breaking and bending the standards, because pounding with hammers or similar tools may be required to penetrate relatively hard earth.

Other exemplary applications for ground-inserted devices include fence posts, tent stakes, ground anchors and exterior lighting, which can include temporary and relocatable light posts. Such devices can be hammered or augured in place. Ground boring excavation equipment can also be used for installing poles, posts and the like. However, previous ground-inserted devices, and the tools and equipment for installing same, tended to be somewhat inefficient in operation, as compared to the insertion and extraction apparatus of the present invention. Moreover, previous devices often required substantial strength or tools for penetrating hardened or frozen soil, and for extracting devices that were firmly or deeply embedded in the ground. Therefore, the design and performance objectives for ground-mounted devices include efficient insertion and extraction with minimal force. Other objectives include the ability to accommodate various adverse soil conditions, such as hard and rocky soil. Still further objectives include ease-of-use, compatibility with various ground-mounted devices and "tool-free" insertion and extraction.

Slaphammers comprise a type of tool with weighted, sliding components impacting stops whereby the impact forces are transferred to work pieces, which are connected to or engaged by the tool. The present invention utilizes the slaphammer operating principle for driving a standard or pole into and out of the ground. The Paulson U.S. Pat. No. 3,143,817 discloses sign holders with impact elements for driving a pointed lower end of the sign holder into the ground and for removing same. The Classen U.S. Pat. No. 4,279,104 discloses a sign post construction with a reciprocable driver for placement and removal.

Heretofore there has not been available an apparatus for inserting and extracting devices in the ground with the advantages and features of the present invention.

BRIEF DESCRIPTION OF THE INVENTION

In the practice of one aspect of the present invention, an apparatus is provided for double-acting impact insertion in and extraction from the ground. The apparatus is adapted for mounting and attaching various other devices, including signage, lines and structures. The apparatus includes a core with upper and lower sections interconnected by a reduced-diameter medial guide shaft. The core upper end is adapted for mounting a device, such as signage, and the core lower end is pointed for ground insertion. A hollow, tubular sleeve includes a bore reciprocally receiving the core. An impact collar is fixedly mounted in the sleeve bore and slides on the guide shaft for impacting the core upper and lower sections on insertion and extraction strokes respectively.

BRIEF DESCRIPTION OF THE DRAWINGS

The drawings constitute a part of this specification and include exemplary embodiments of the present invention and illustrate various objects and features thereof.

DETAILED DESCRIPTION OF THE INVENTION

Figure 1:
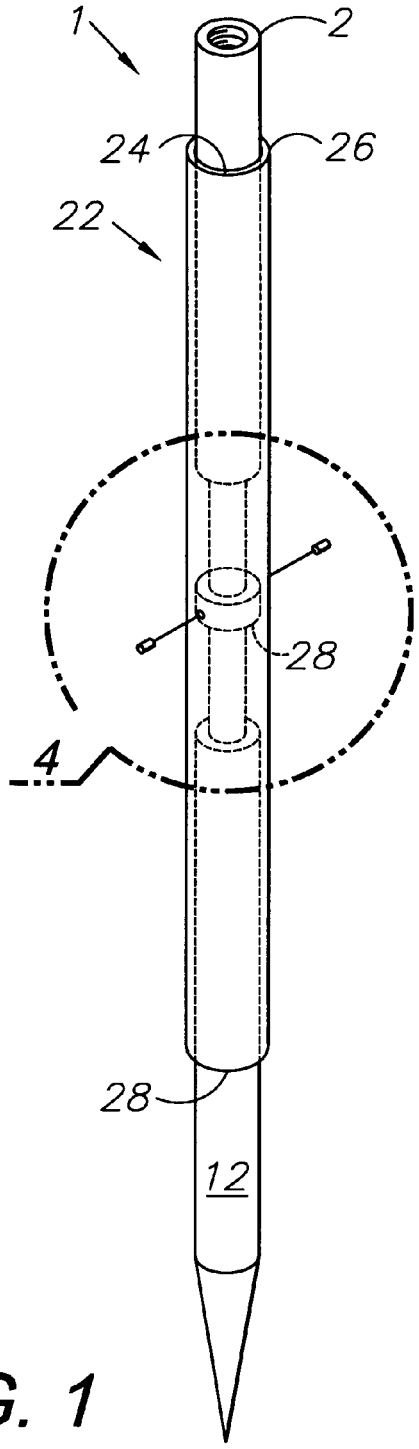
FIG. 1 is an upper, perspective view of an impact insertion and extraction apparatus comprising an aspect of the present invention.
Figure 2:
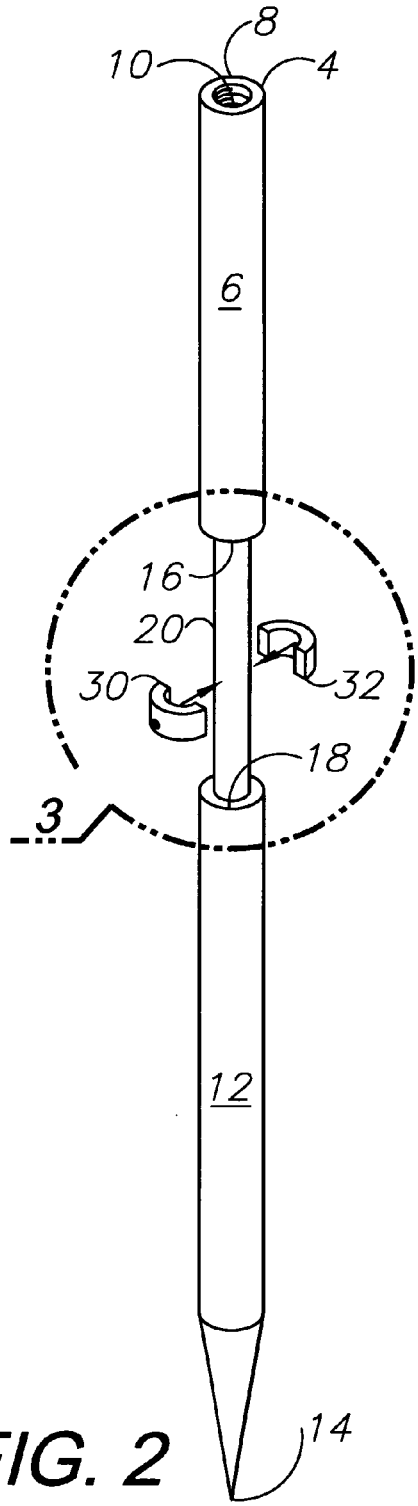
FIG. 2 is a fragmentary, upper, perspective view showing a core thereof.

As required, detailed embodiments and/or aspects of the present invention are disclosed herein; however, it is to be understood that the disclosed embodiments/aspects are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail, the reference numeral 2 generally designates an impact-driven standard embodying one aspect of the present invention. Without limitation on the generality of useful applications of the invention in its different aspects and embodiments, the standard 2 is adapted for being driven into and out of the ground and for mounting and attaching various items such as signage, lines, lights, etc.

The standard 2 generally comprises a core 4 with an upper section 6 terminating at a core upper end 8 having a female-threaded receiver 10 and a core lower section numeral 12 terminating at a pointed lower end 14. The core upper and lower sections 6, 12 respectively have upper and lower shoulders 16, 18 positioned in vertically-spaced relationship with a core guide shaft 20 extending therebetween and having a reduced diameter with respect to the upper and lower sections 6, 12.

Figure 3:
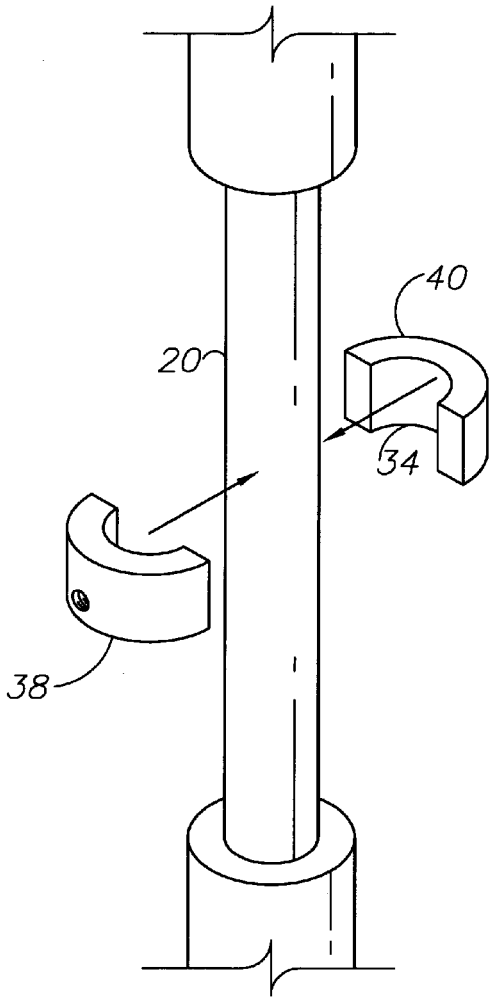
FIG. 3 is a fragmentary, upper, perspective view of a portion of the core located generally in circle 3 in FIG. 2.
Figure 4:
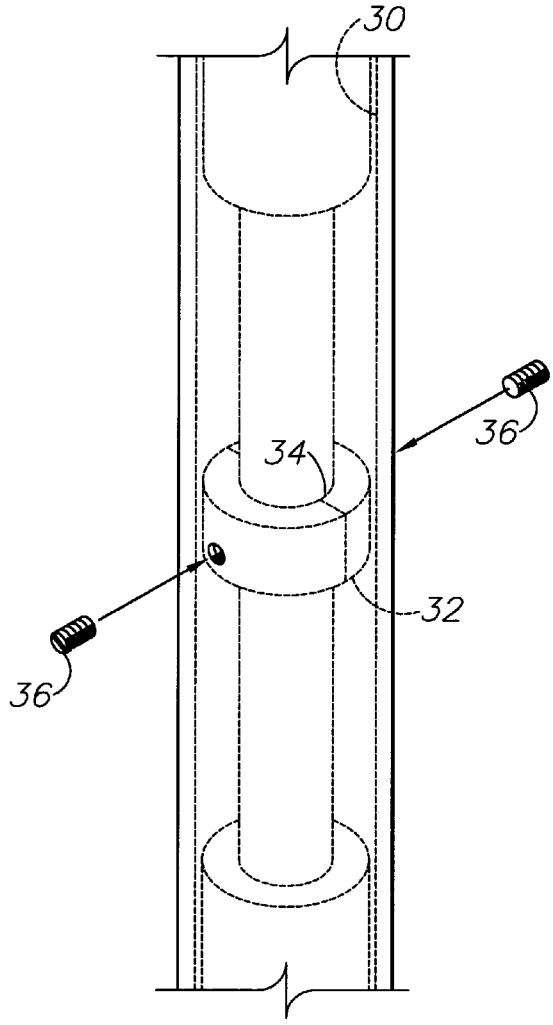
FIG. 4 is a fragmentary, upper, perspective view of a portion of the apparatus, located generally in circle 4 in FIG. 1.

A reciprocating impact sleeve assembly 22 includes a tube 24 with upper and lower ends 26, 28 and a tube bore 30 extending therebetween and open thereat. An impact collar 32 includes a passage 34 slidably, reciprocally receiving the guide shaft 20. The impact collar 32 is fixedly secured to the tube 24 by set screws 36 within the tube bore 30 approximately midway between the tube ends 26, 28. FIG. 3 shows a construction of the impact collar 32 in first and second halves 38, 40 whereby the standard 2 can be assembled by inserting the core 4 into the tube bore 30 with the impact collar halves 38, 40 loosely (i.e., unattached) placed on the guide shaft 20, whereafter the impact collar halves 38, 40 can be positioned within the tube 24 for placement of the set screws 36.

Figure 5:
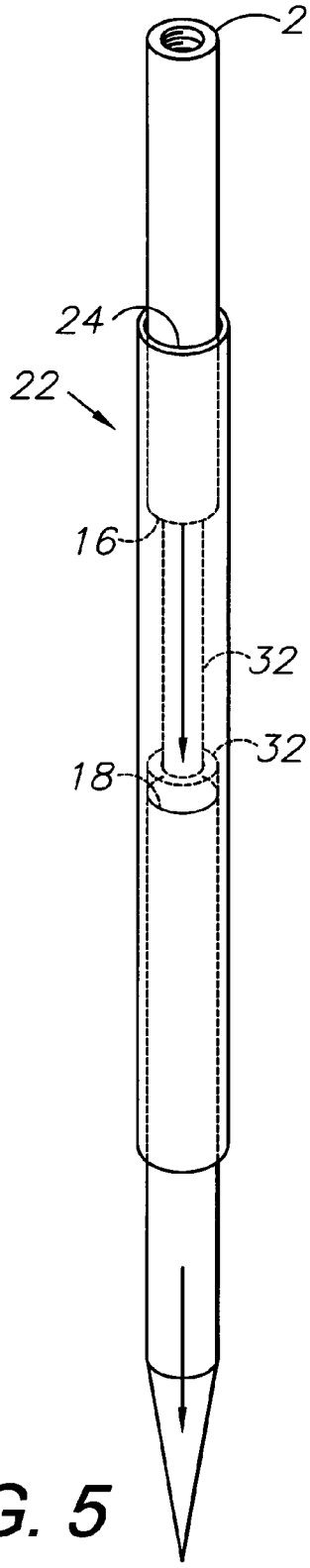
FIG. 5 is an upper, perspective view of the apparatus, showing an impact sleeve thereof in its lowermost position corresponding to an insertion stroke.
Figure 6:
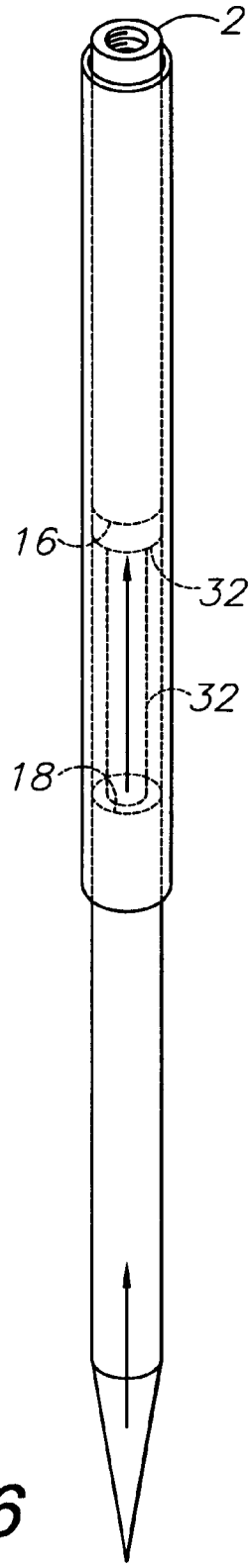
FIG. 6 is an upper, perspective view of the apparatus, showing the impact sleeve thereof in its uppermost position corresponding to an extraction stroke.

FIG. 5 shows the impact sleeve assembly 22 in its lowermost position corresponding to an insertion stroke for the standard 2, with the impact collar 32 engaging the lower shoulder 18 for driving the core lower section pointed end 14 into the ground. FIG. 6 shows the impact sleeve assembly 22 in its uppermost position corresponding to an extraction stroke for the standard 2, with the impact collar 32 engaging the upper shoulder 16 whereby the core lower section 12 is extracted.

Figure 7:
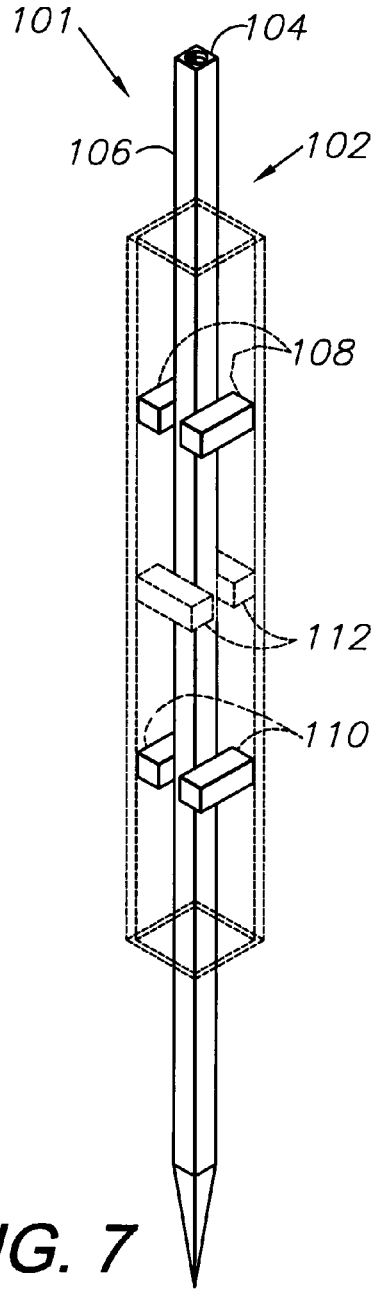
FIG. 7 is an upper, perspective view of a first modified embodiment or aspect of the invention.

FIG. 7 shows an apparatus 101 comprising a first modified embodiment or aspect of the invention, with a standard 102 comprising a core 104 with a shaft 106 having a square cross-sectional configuration. The shaft 106 mounts upper and lower pairs of stops 108 and 110 respectively. A square tube 112 reciprocally receives the core 104 and includes a pair of impact bars 112 fixedly mounted therein and adapted for engagement by the stops 108, 110 on insertion and retraction strokes respectively.

Figure 8:
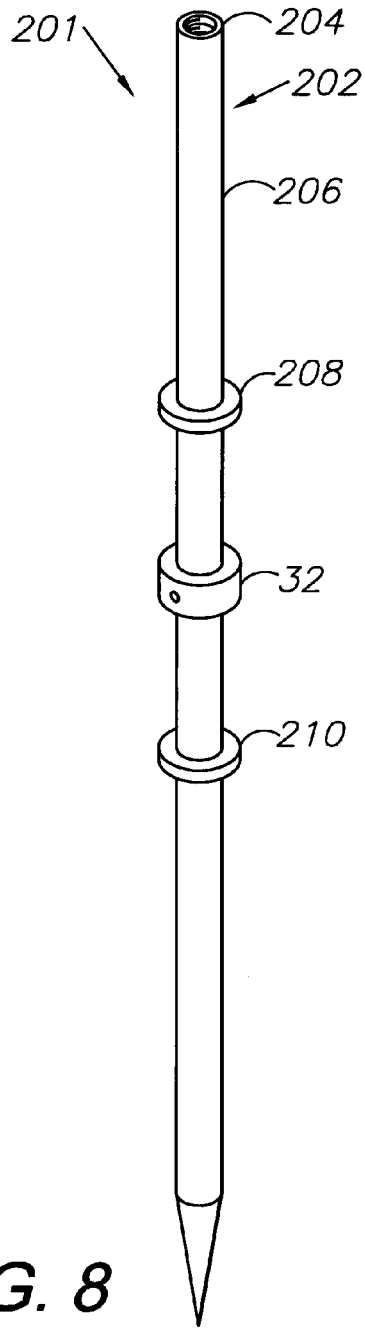
FIG. 8 is an upper, perspective view of a second modified embodiment or aspect of the invention.

FIG. 8 shows an apparatus 201 comprising a second modified embodiment or aspect of the invention, with a standard 202 comprising a core 204 with a shaft 206 fixedly mounting upper and lower stop washers 208, 210 respectively. For example, the washers 208, 210 can be welded in place. The core 204 is adapted for reciprocally mounting in an impact sleeve assembly 22 as described above, with an impact collar 32 reciprocally receiving the shaft 206.

Figure 9:
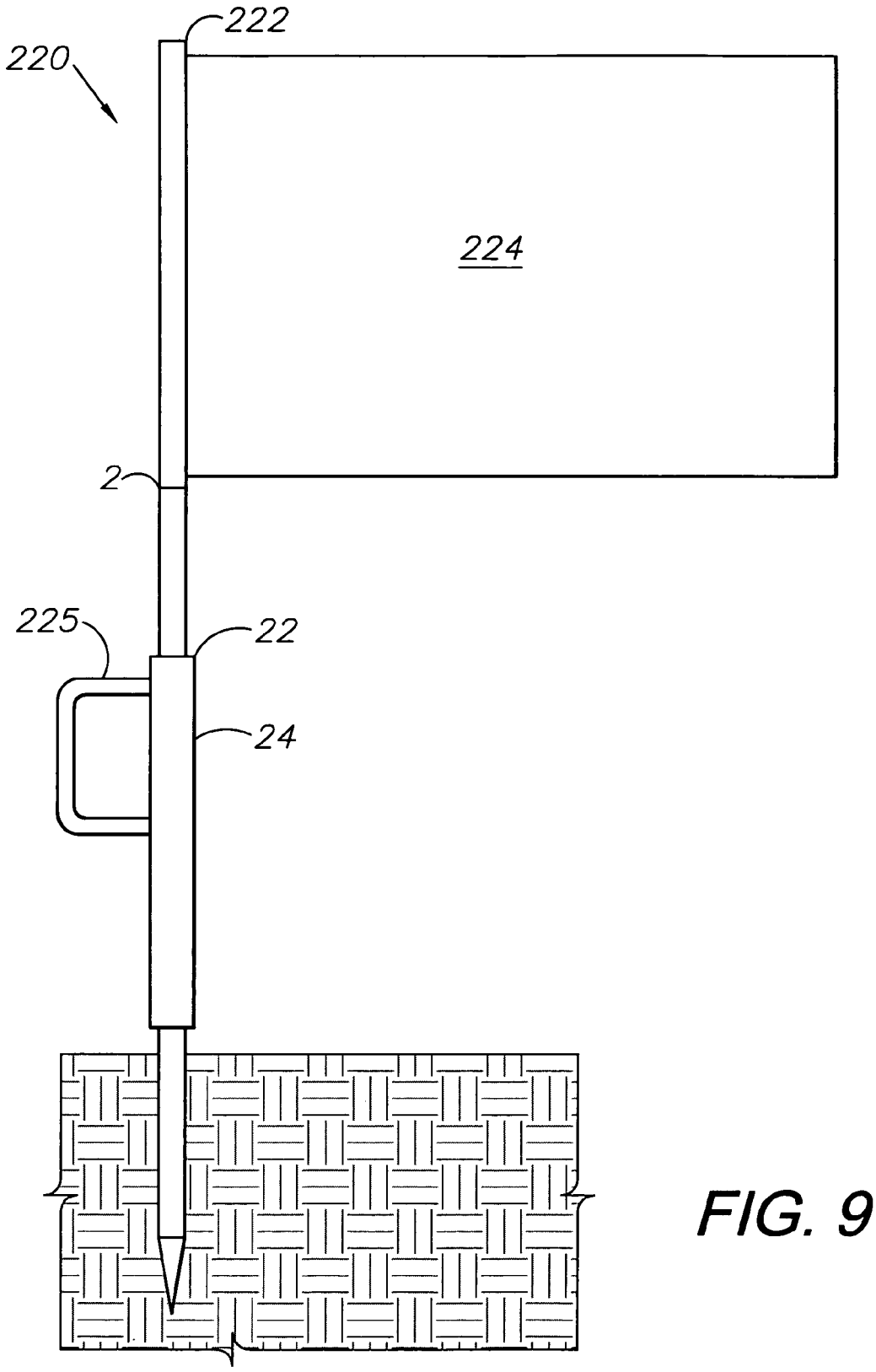
FIG. 9 is a front elevational view of an application of the apparatus, shown mounting a sign.

FIG. 9 shows an application of the apparatus 1 as a standard 2 mounting a sign assembly 220, with a rod 222 threadably received in the core receiver 10 and a sign panel 224 extending laterally therefrom. A handle 225 extends laterally from the tube 24 and provides a convenient grip for reciprocating the impact sleeve assembly 22 up and down for facilitating insertion and extraction operations.

Figure 10:
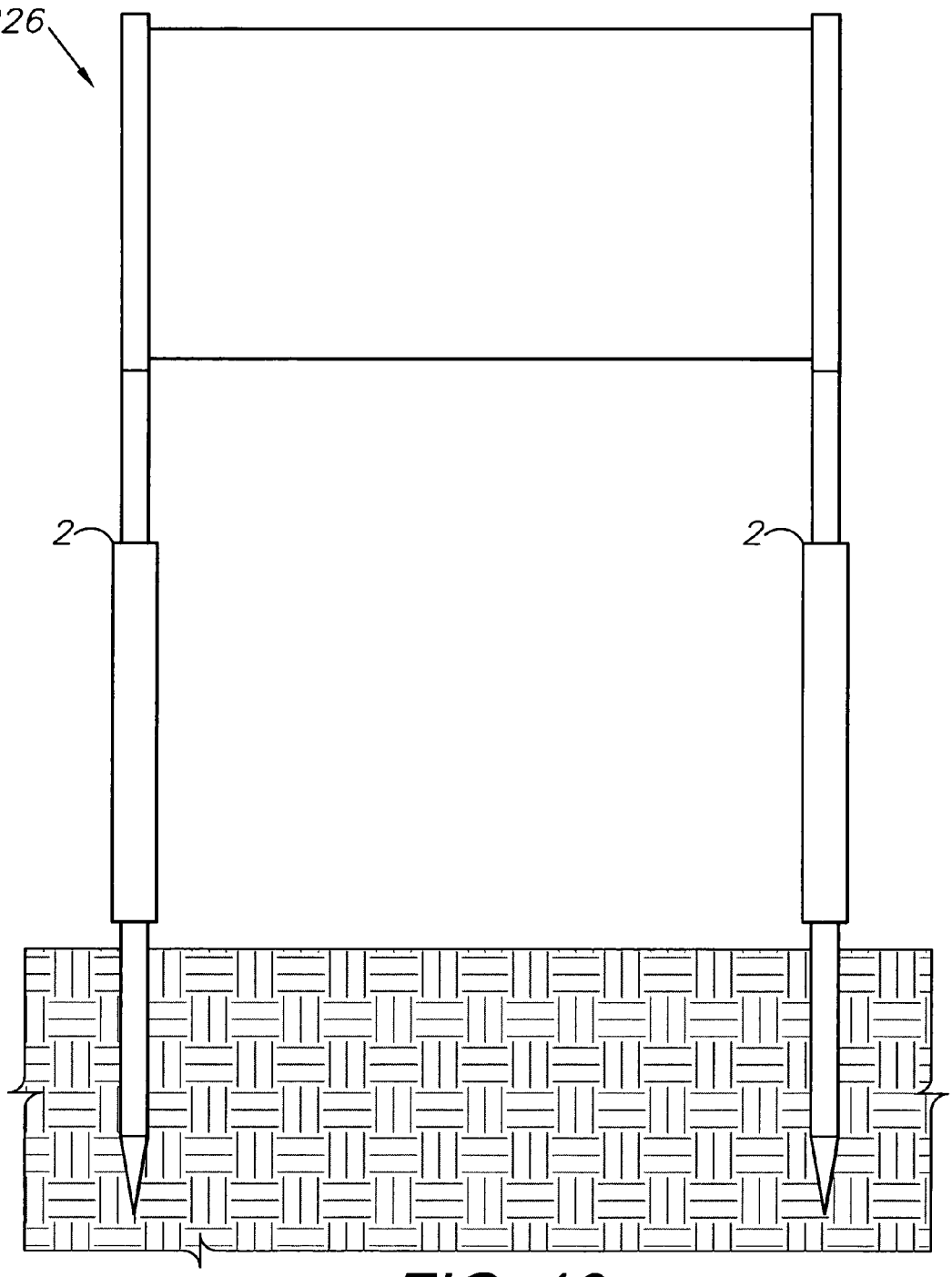
FIG. 10 is a front elevational view of another application of the apparatus, shown mounting a sign on two standards.

FIG. 10 shows another application of the apparatus 1 with a pair of standards 2 inserted in the ground in spaced relation and mounting a sign assembly 226 therebetween.

Figure 11:
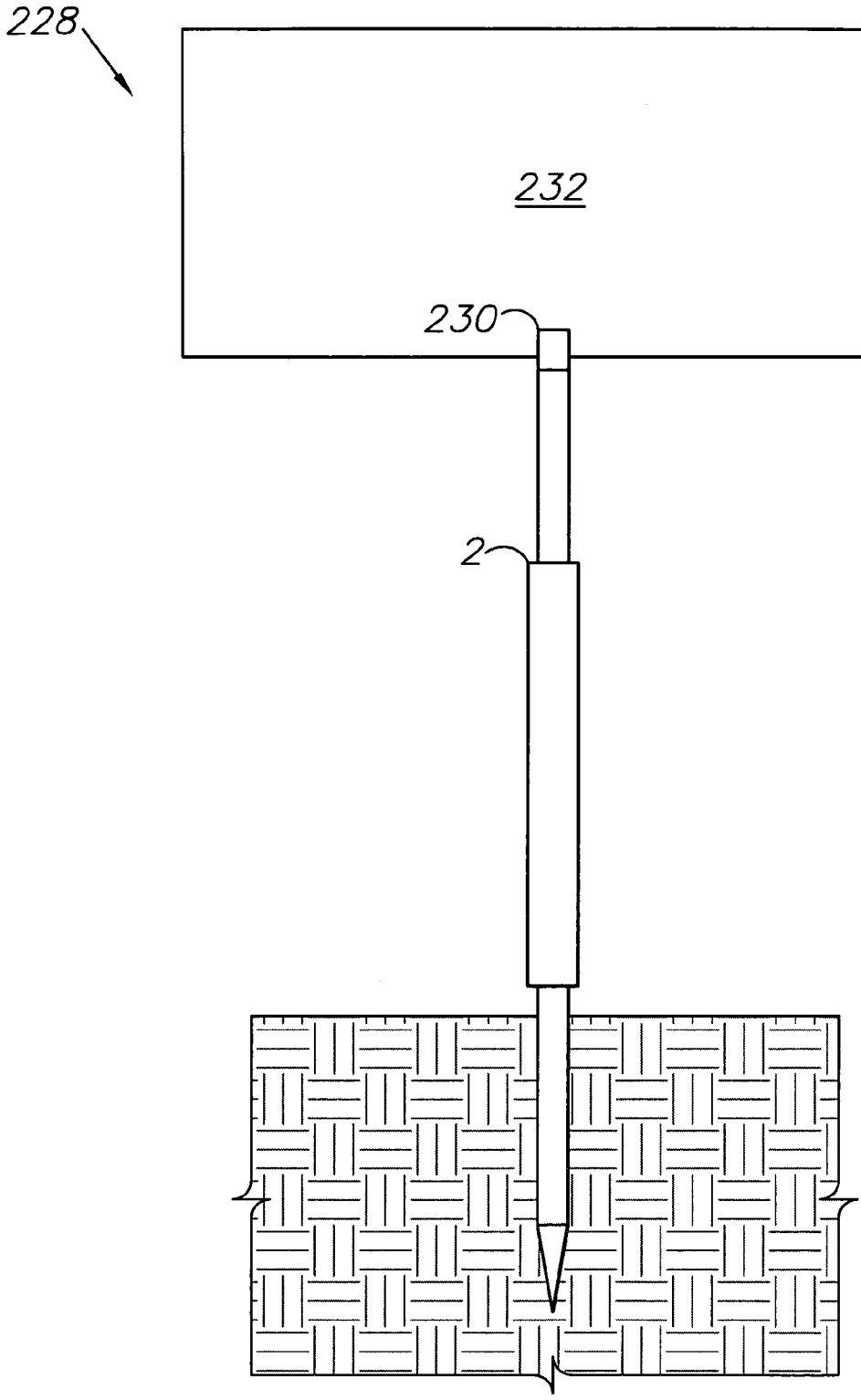
FIG. 11 is a front elevational view of another application of the apparatus, shown mounting a sign.

FIG. 11 shows another application of the apparatus 1 with a sign assembly 228 mounted on the standard 2. The sign assembly 228 includes a bracket 230 threadably received in the core receiver 10 and mounting a sign panel 232.

Figure 12:
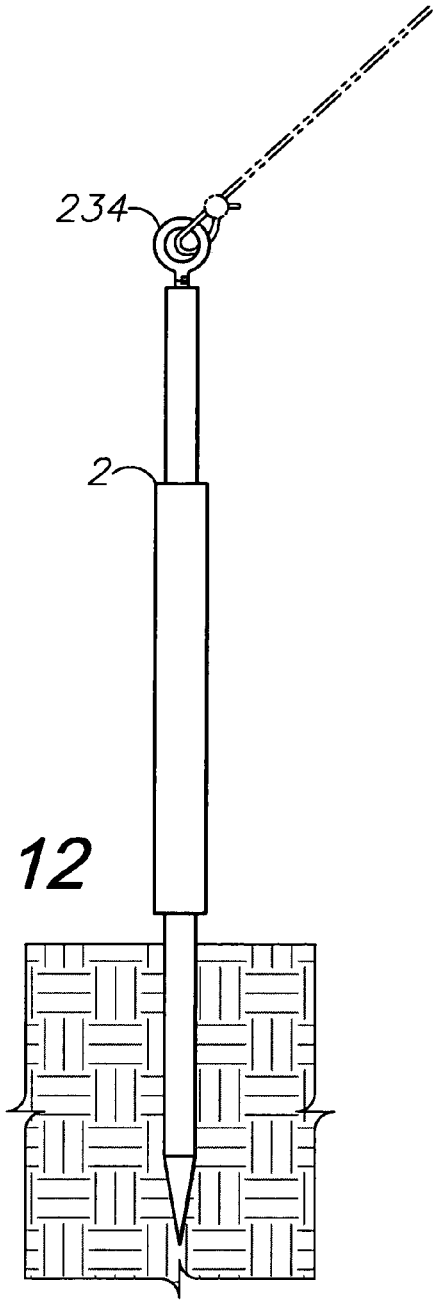
FIG. 12 is a front elevational view of another application of the apparatus, showing attaching a line.

FIG. 12 shows another application of the apparatus 1 with the standard receiver 10 threadably receiving an eye bolt 234, which is adapted for securing a line 236.

Figure 13:
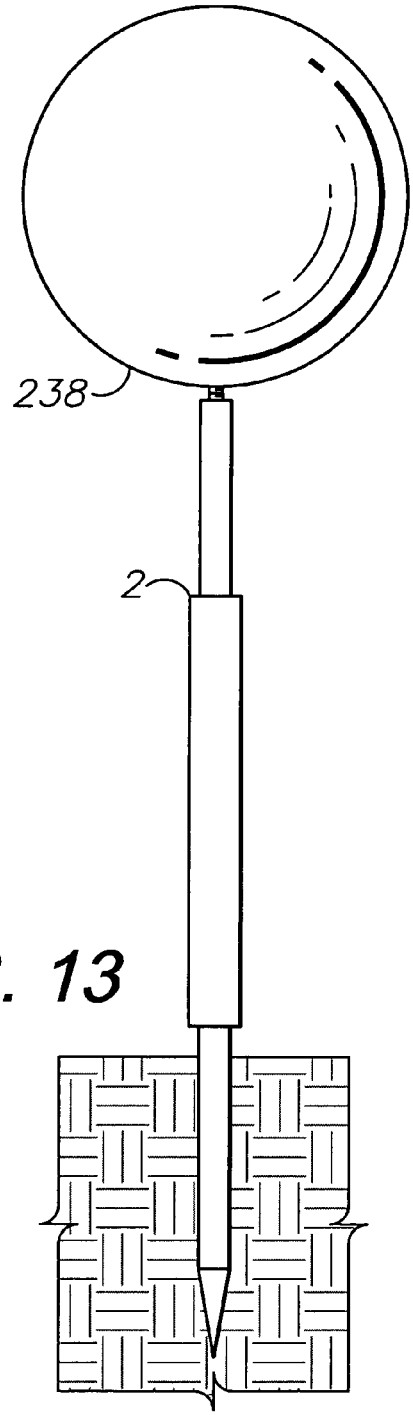
FIG. 13 is a front elevational view of another application of the apparatus, shown mounting a light fixture.
Figure 14:
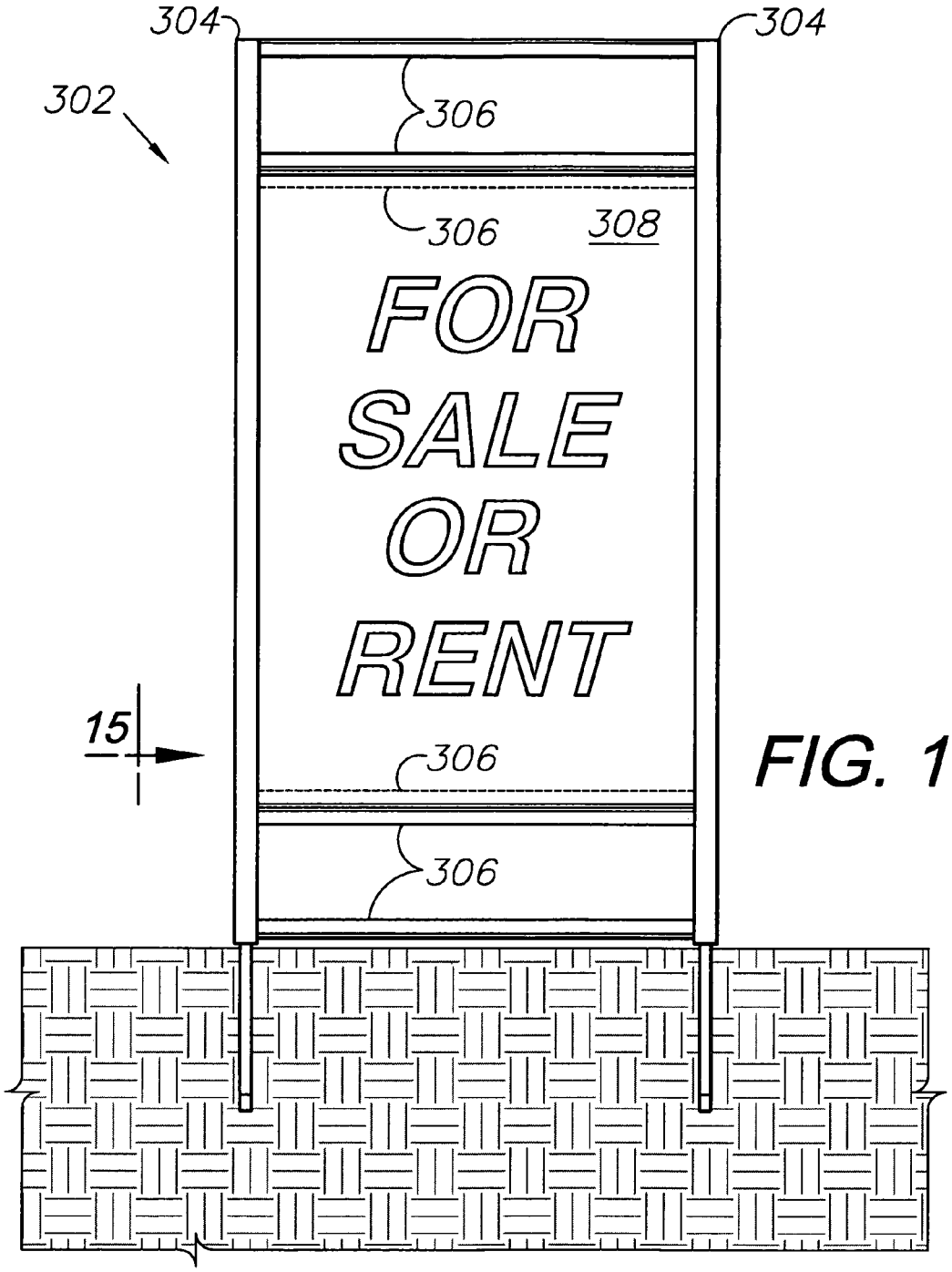
FIG. 14 is a front elevational view of a sign comprising a second modified embodiment or aspect of the invention.

FIG. 13 shows another application of the apparatus 1 with the standard 2 mounting a temporary, relocatable light fixture 238, which can include a self-contained photovoltaic power source for portability and independence from external power sources.

FIGS. 14-17 show another aspect of the invention comprising a sign 302 with multiple standards 304 inserted into the ground in spaced relationship and multiple cross-members 306 extending horizontally therebetween. Signage 308 can be placed between the standards 304 and the cross-members 306 of the sign 302.

Figure 15:
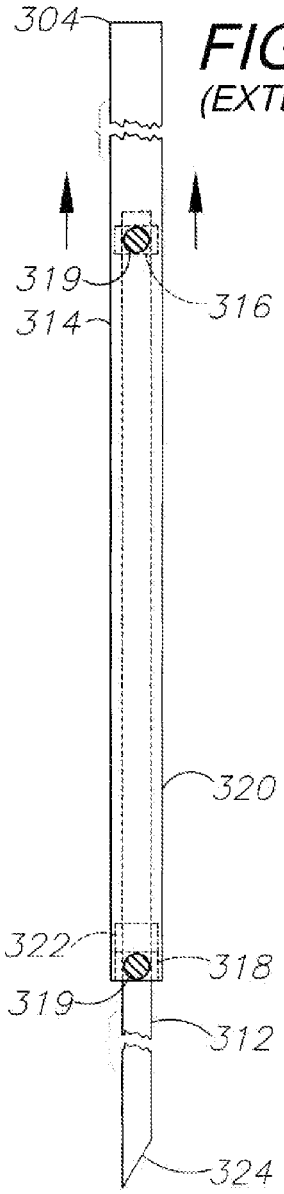
FIG. 15 is a side elevational view thereof taken in generally at 15 in FIG. 14 and showing a core thereof in an extended position.

FIG. 15 shows one of the standards 304 comprising a shaped core 312 partly telescopically received within a square tubular shaft 314 fixedly mounting upper and lower shoulders 316, 318 respectively. For example, the shoulders 316, 318 can be welded inside the shaft at spot welds 319. The core 312 is adapted for reciprocally mounting in an impact sleeve assembly 320, with an impact collar 322 fixedly mounted (e.g., spot welded) on the core 312 and reciprocally received in the shaft 314.

Figure 16:
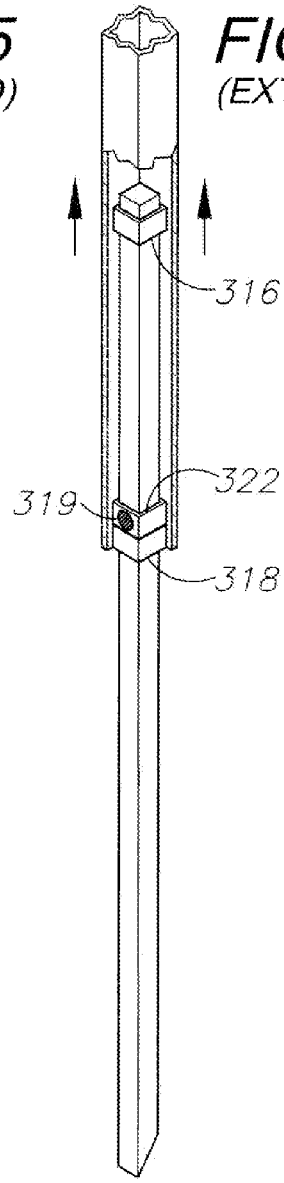
FIG. 16 is a fragmentary, upper, perspective view thereof with the core in an extended position.
Figure 17:
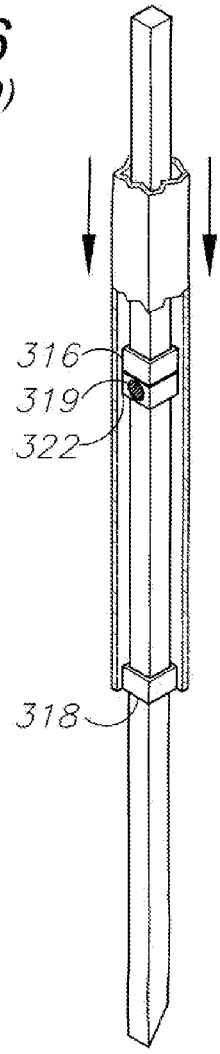
FIG. 17 is a fragmentary, upper, perspective view thereof with the core in a retracted position.

FIGS. 15 and 16 show the impact sleeve assembly 320 in its lowermost, extended position corresponding to the end of an extraction stroke for the standard 304, with the impact collar 322 engaging the lower shoulder 318 for extracting the core lower section pointed end 324 from the ground. FIG. 17 shows the impact sleeve assembly 320 in its uppermost, retracted position corresponding to the end of an insertion stroke for the standard 304, with the impact collar 322 engaging the upper shoulder 316 whereby the core lower section 326 is impact-driven into the ground.

It will be appreciated that the components of the apparatus 1 can be used for various other applications. Moreover, the standards can be fabricated in various sizes and from a wide range of suitable materials, using various manufacturing and fabrication techniques.

It is to be understood that while certain embodiments and/or aspects of the invention have been shown and described, the invention is not limited thereto and encompasses various' other embodiments and aspects.

Having thus described the invention, what is claimed as new and desired to be secured by Letters Patent is:

1. An impact driven standard, which comprises:

a core with an upper section terminating at an upper end, a lower section terminating at a lower end and a guide shaft extending between and connected to said upper and lower sections;

an impact sleeve including an upper end, a lower end and a bore, extending therebetween and reciprocally receiving said core whereby said core and said sleeve are axially movable relative to each other;

at least one impact collar medially secured to said guide shaft and surrounding same;

said sleeve including first and second shoulders;

said impact collar being adapted to impact said shoulders;

said core extending axially outwardly from said impact sleeve in an extended position thereof; and said core having a retracted position at least partly in said sleeve.

2. The impact driven standard according to claim 1 wherein said core upper end includes a female-threaded receiver and said core lower end is pointed.

3. The impact driven standard according to claim 2, which includes:

an attachment having a male-threaded rod and a fixture mounted on said rod, said rod being threadably receivable in said core upper end receiver.

4. The impact driven standard according to claim 3 wherein said fixture comprises one of a display panel, a light structure and an eyelet.

5. The impact driven standard according to claim 1 wherein said sleeve, said core, said shoulders and said collar have generally circular cross-sectional, configurations.

6. The impact driven standard according to claim 1, which includes:

a U-shaped handle mounted on and extending laterally from said sleeve and adapted for facilitating extension and retraction operations.

7. An impact driven standard, which comprises:

a core with an upper section terminating at a female-threaded core upper end, a lower section terminating at a pointed core lower end and a guide shaft extending between and connected to said upper section and said lower section;

a reciprocating impact sleeve with an upper end, a lower end and a bore extending between and open at said ends for receiving said core wherein said core and the reciprocating impact sleeve move axially with respect to each other;

at least one impact collar including a first half and a second half shaped such that said collar is medially secured around said guide shaft for reciprocally receiving said shaft between said upper and lower ends and mechanically fastened to said sleeve;

said core including a first shoulder wherein the shoulder is adjacent to said core upper section and welded to said core;

said core including a second shoulder wherein the shoulder is adjacent to said core lower section and welded to said core;

said impact collar being adapted to impact said shoulders;

said core extending axially outwardly from said impact sleeve causing said impact collar to engage said first shoulder in an extended position thereof; and said core having a retracted position at least partly in said sleeve causing said impact collar to engage said second shoulder in a retracted position.

8. A sign, which comprises:

a sign display panel having a top, a bottom and side edges;

a pair of standards including: a core with an upper section, a lower section terminating at a pointed core lower end, a guide shaft extending between and connected to said upper section and said lower section; a collar including a first half and a second half shaped such that said collar is medially mechanically secured around said guide shaft between said upper and lower ends; a reciprocating impact sleeve with an upper end, a lower end and a bore extending between and open at said ends for receiving said core wherein said core and the reciprocating impact sleeve move axially with respect to each other; said sleeve including a first shoulder welded to said impact sleeve adjacent to said sleeve upper end and, said sleeve including a second shoulder welded to said impact sleeve adjacent to said sleeve lower end;

said core having an extended position axially outwardly from said impact sleeve whereat said impact collar engages said first shoulder;

said core having a retracted position at least partly in said sleeve whereat said impact collar engages said second shoulder;

top, bottom, upper interior and lower interior cross-members, each said cross-member extending between and mechanically fastened to said standards, said top cross-member positioned adjacent to said sleeve upper ends, said bottom cross-member positioned adjacent to said sleeve lower end, said upper interior cross-member positioned below said top cross-member, and said lower interior cross-member positioned above said bottom cross-member;

said top and bottom cross-members each including a single angled section;

said upper and lower interior cross-members including two single angled sections welded to each other in a back-to-back configuration;

said sign display panel being generally positioned between said upper and lower interior cross-members; and said sign display panel top edge being mechanically fastened to said upper interior cross-members and said sign display panel bottom edge being mechanically fastened to said lower interior cross-member.

9. An impact driven standard, which comprises:

a core with an upper section terminating at an upper end, a lower section terminating at a lower end and a guide shaft extending between and connected to said upper and lower sections;

an impact sleeve including an upper end, a lower end and a bore extending therebetween and reciprocally receiving said core whereby said core and said sleeve are axially movable relative to each other;

at least one impact collar fixed to said sleeve within said bore and including semicircular first and second halves secured to said sleeve in opposed relation to each other with said guide shaft surrounded therebetween;

said core including at least one shoulder;

said impact collar being adapted to impact said shoulder;

said core extending axially outwardly from said impact sleeve in an extended position thereof; and said core having a retracted position at least partly in said sleeve.

10. The impact driven standard according to claim 9, which includes a mechanical fastener fixing said impact collar to said sleeve.

11. The impact driven standard according to claim 9 wherein said impact collar is welded to said sleeve.

12. An impact driven standard, which comprises:

a core with an upper section terminating at an upper end, a lower section terminating at a lower end and a guide shaft extending between and connected to said upper and lower sections;

an impact sleeve including an upper end, a lower end and a bore extending therebetween and reciprocally receiving said core whereby said core and said sleeve are axially movable relative to each other;

an impact collar fixedly secured to one of said impact sleeve and said core;

the other of said sleeve and said core including first and second shoulders adapted for being impacted by said collar;

said core extending axially outwardly from said impact sleeve in an extended position thereof; and said core having a retracted position at least partly in said impact sleeve.

* * * * *